US005185974A

United States Patent [19]

Diehl

[11] Patent Number: 5,185,974

[45] Date of Patent: Feb. 16, 1993

[54] DUCTED FRIEZE VENT

[76] Inventor: Rollie S. Diehl, 1301 W. Runyon Dr., Phoenix, Ariz. 85027

[21] Appl. No.: 766,741

[22] Filed: Sep. 27, 1991

[51] Int. Cl.[5] ..... E04B 7/02

[52] U.S. Cl. ..... 52/95; 52/90; 52/199; 52/303; 454/260

[58] Field of Search ..... 52/90, 95, 198, 199, 52/473, 302, 303, 218; 454/260

[56] References Cited

U.S. PATENT DOCUMENTS

| | | | |
|---|---|---|---|
| 2,477,152 | 7/1949 | Stevenson | 52/303 |
| 3,777,649 | 12/1973 | Luckey | 52/95 |
| 3,863,553 | 2/1975 | Koontz | 52/95 X |
| 4,007,672 | 2/1977 | Luckey | 52/90 X |
| 4,189,878 | 2/1980 | Fitzgerald | 52/95 |
| 4,269,007 | 5/1981 | Ward | 52/95 X |
| 4,565,037 | 1/1986 | Deschane | 52/90 X |
| 4,642,958 | 2/1987 | Pewitt | 52/90 X |
| 5,094,054 | 3/1992 | Arends | 52/95 X |

FOREIGN PATENT DOCUMENTS

| | | | |
|---|---|---|---|
| 2118991 | 11/1983 | United Kingdom | 52/199 |

*Primary Examiner*—David A. Scherbel
*Assistant Examiner*—Kien Nguyen
*Attorney, Agent, or Firm*—James F. Duffy

[57] ABSTRACT

A ducted frieze vent which creates a duct-way for the free flow of air beneath the roof sheathing and between a pair of roof rafters and into the space beneath the building's roof. The frieze board employed has a sufficient thickness to accept a nail driven down through the roof sheathing as is required by many building codes. The duct-way is provided with a removable closure which is first positioned to prevent entry of airborne insulation into the duct-way. After insulation has been emplaced, the duct-way closure is removed by manual actuation of a rod by a person exterior of the building and of the insulated space.

13 Claims, 1 Drawing Sheet

FIG. 1
(PRIOR ART)
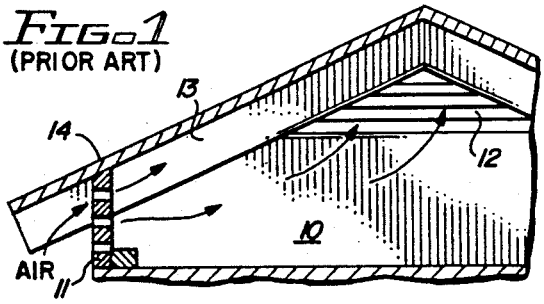
FIG. 2
(PRIOR ART)
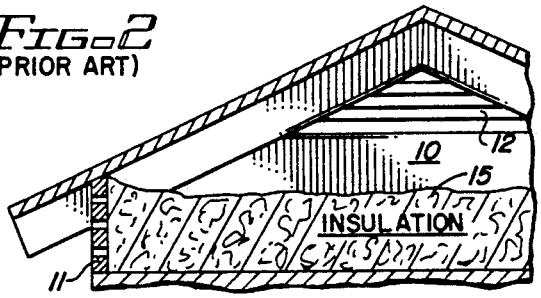
FIG. 3
(PRIOR ART)
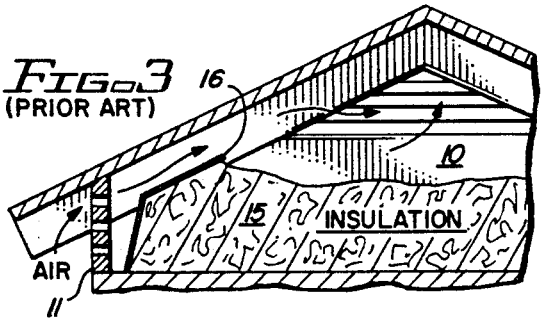
FIG. 4
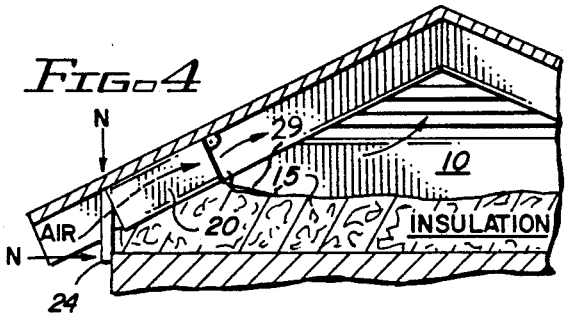
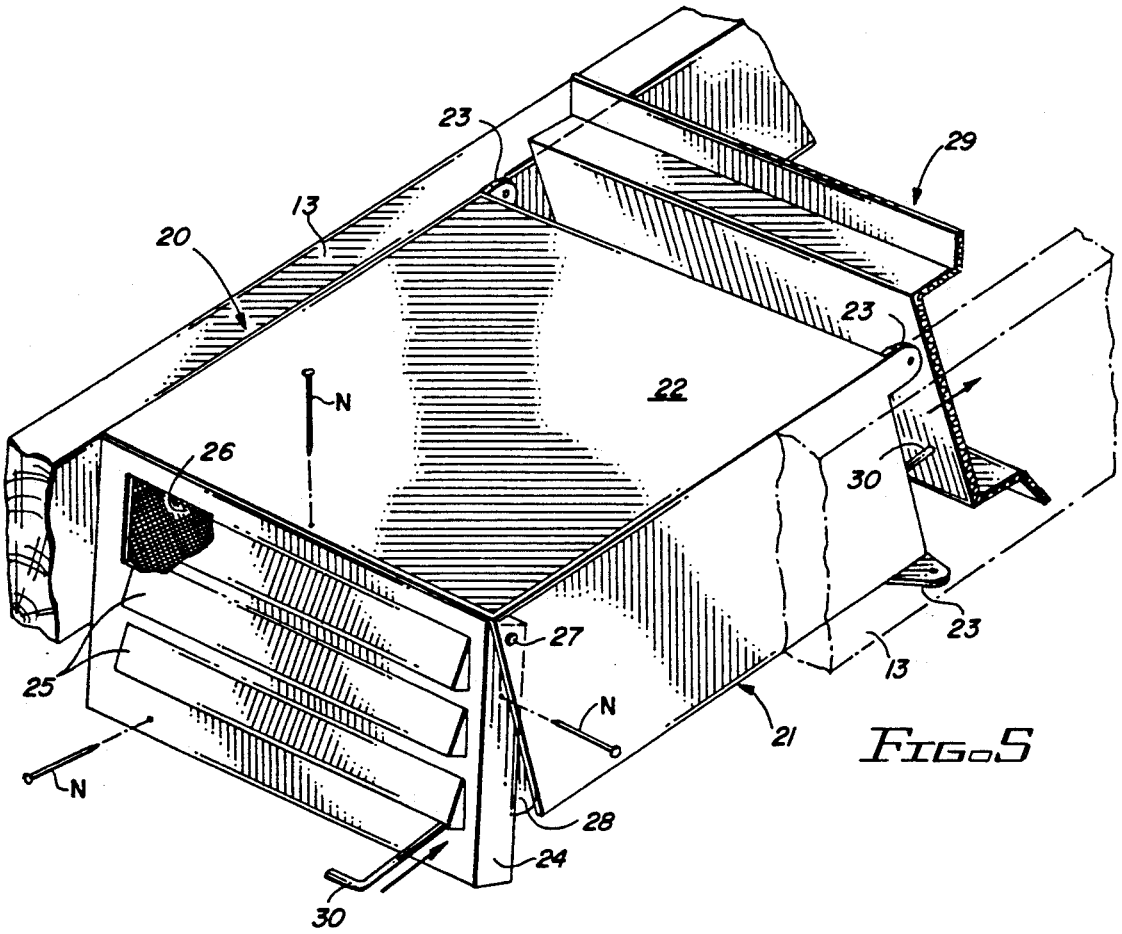
FIG. 5

DUCTED FRIEZE VENT

BACKGROUND

1. Field of the Invention

The invention relates to frieze board vents for ventilating attic spaces. In particular, frieze vents coupled to attic duct work are disclosed.

2. Prior Art

A well ventilated attic space tends to keep the interior of the building cooler during summer weather. To further reduce the load on any equipment employed for cooling the interior of the building, the attic space is generally insulated. In many instances this insulation is a type which is applied by blowing it into the space beneath the roof of the building. As most frequently happens, when such insulation is blown into this space, the air flow through the soffit ventilators provided by the builder becomes blocked and air flow into and through this space is drastically reduced or eliminated.

Many innovative devices have been conceived to offset this problem. Most are after-the-fact solutions. That is, the devices are employed to correct the problem after the fact of the insulation blocking the vents.

Some devices are intended to be installed after the roof sheathing is in place and prior to the installation of the insulation. This interferes with the normal routine of the builders whose carpenters generally will install the frieze board between roof rafters before the roof sheathing has been emplaced above the frieze board. Devices to be installed prior to insulating this space also suffer in that their outlet end, that is the end through which ventilating air must exit into the space is subject to receiving the air-blown insulation and suffering the same blockage as the simple soffit vents.

It is the intent of the invention that apparatus shall be provided which can be installed in the normal course of erecting a building prior to the installation of roof sheathing above the frieze board area. The apparatus shall provide free flow of air into the space beneath the roof and shall not be susceptible to blockage when insulation is blown into the space. Entrance to the apparatus shall be a frieze board which is a structural element meeting the building codes and having sufficient thickness to accept a nail driven down through the roof sheathing into the frieze board.

SUMMARY OF THE INVENTION

There are at least three aspects of the invention. Each is presented as an improvement in a building having roof sheathing supported by rafters, and a space beneath the sheathing to be ventilated by air flowing beneath the sheathing and between selected pairs of the rafters, and insulation applied to the space, the application of the insulation tending to block the free flow of air into the space.

In a first aspect, the improvement is disclosed as comprising an air ventilation duct coupled between one of the selected pairs of the rafters for the free flow passage of air therethrough to the space to be ventilated, the duct having an input end and an output end for the entry and exit of air. There is a closure for closing the output end of the duct to preclude the entry into the duct of the insulation when the insulation is applied to the space. Means are coupled to the closure means for opening the output end of the duct after the insulation has been applied. The means for opening the output end of the duct is coupled through the input end of the duct to the closure means for moving the closure.

A vented frieze board is coupled between the one of the selected pairs of the rafters and adjacent the input end of the duct. The coupling means comprises means pivotally coupling the vented frieze board at the input end of the duct. The frieze board has a thickness sufficient to accept a nail driven through the sheathing and into the frieze board.

In a second aspect, the improvement is disclosed as an air ventilation duct coupled between one of the selected pairs of the rafters for the free flow passage of air therethrough to the space to be ventilated, the duct having an input end and an output end for the entry and exit of air; and, a vented frieze board pivotally coupled to the duct adjacent the input end of the duct. The vented frieze board has a thickness sufficient to accept a nail driven through the sheathing and into the frieze board. There are closure means closing the output end of the duct for precluding the entry into the duct of the insulation when the insulation is applied to the space. There are means coupled to the closure means for opening the output end of the duct after the insulation has been applied. The means for opening the output end of the duct are coupled through the input end of the duct to the closure means and comprise means for moving the closure.

In its third aspect, the invention is disclosed, in combination with the sheathing and the rafters, as means forming an air flow duct-way beneath the sheathing and between one of the selected pairs of rafters, the duct-way having input and output ends. Included are closure means for temporarily closing the output end of the duct-way to inhibit accessible entry to the duct-way through the output end. As before, there are means coupled to the closure means, through the input end of the duct-way, for moving the closure means to open the output end of the duct-way. A vented frieze board is coupled to the duct-way adjacent the input end. There are pivotal coupling means pivotally coupling the frieze board to the duct-way. And, the vented frieze board has a thickness sufficient to accept a nail driven through the sheathing and into the frieze board.

DESCRIPTION OF THE DRAWINGS

FIG. 1 illustrates an attic space which is ventilated by means of a vented frieze board and end vents in the end walls of the attic.

FIG. 2 illustrates the same attic of FIG. 1 after insulation has been blown in place causing a blockage of air flow through the vented frieze board.

FIG. 3 illustrates a prior art attempt to prevent blockage of the vented frieze board by installation of a shield separating the vented frieze board and the insulation.

FIGS. 1 through 3 represent prior art.

FIG. 4 illustrates the installation of the ducted frieze vent of the invention in the attic space of FIGS. 1 through 3 showing the insulation level to be below the duct work of the invention.

FIG. 5 is a perspective view showing the details of the invention and its installation between roof rafters in the attic of a building. Means for preventing the entry of insulation into the duct work of the invention is shown.

A DETAILED DESCRIPTION OF THE INVENTION

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

In FIG. 1, a below roof space, attic 10, is indicated as that space formed beneath roof sheathing 14. Roof sheathing 14 is supported by roof rafters 13. Air flows into the attic space 10 through a vented frieze board 11 and exits the attic through end vents 12. This free flow of air prevents a buildup of heat within the attic space and tends to keep the building below the attic, not shown, cooler in summer than would otherwise be the case if no free flow of air were available.

In FIG. 2, the attic of FIG. 1 is again illustrated but with the addition of insulation 15. The purpose of installing insulation 15 is to reduce any heat loads on cooling equipment that may be employed to cool the building spaces below the attic. However, as is often the case, the placement of insulation 15 within attic 10 has blocked the vented frieze board vents and no air flows through the vents into the attic 10. Heat will thus build up within attic 10 and, despite the insulation 15, a greater amount of heat will seep through to the building spaces below the attic than would otherwise seep through if a free flow of air through the attic were available.

The prior art solution shown in FIG. 3 wherein a shield is inserted between insulation 15 and vented frieze board 11 works satisfactorily when the shield 16 has been installed after the installation of insulation 15. Often times, however, when shield 16 is installed prior to the placement of insulation 15, insulation will creep down into the space between shield 16 and the roof sheathing 14, thus effectively blocking the passage of air.

FIG. 4 shows the insulation of the present invention 20 in ventilating attic space 10. Invention 20 and the details of its installation are shown in greater detail in the perspective view of FIG. 5.

Examination of FIGS. 4 and 5 indicate that the invention 20 is a ducted frieze vent which creates a duct-way beneath roof sheathing 14 and between a pair of rafters 13. Invention 20 is intended to create a passageway for the free flow of air through this duct-way and into a below roof space such as attic 10.

In a presently preferred embodiment, invention 20 is comprised of a duct 21. As illustrated, duct 21 has a top and bottom and two sides. In practice, the duct top 22 is optional since roof sheathing 14 will suffice to contribute a top wall to the duct-way. Further, much of the side walls of duct 21 may be made up of rafters 13. However, because of the ease with which workman may handle the unit during the construction of a building, the invention 20 is illustrated with a fully enclosed duct 21.

Duct 21 is positioned between rafters 13. Attachment tabs 23 are provided to assist in securing duct 21 in position between rafters 13. To maintain duct 21 in position nails, not shown, are driven through attachment tabs 23 and into rafters 13.

Duct 21 is positioned between rafters 13 so that louver vented frieze board 24 assumes a generally vertical disposition as illustrated in FIG. 4. To aid in the positioning of vented frieze board 24, the frieze board is pivotally coupled at 27 to duct 21. As frieze board 24 pivots about coupling 27 a sliding side wall 28, attached to frieze board 24, is more or less exposed. That is, as frieze board 24 is pivoted outwardly away from duct 21, more of the sliding side wall 28 is exposed. The purpose of sliding side wall 28 is to assure that no insulation will enter into the space between frieze board 24 and the entry of duct 21 when the insulation is blown into attic 10.

Frieze board 24 is intended to be both decorative and utilitarian. In the illustration of FIG. 5, several louvers 25 are indicated. These louvers provide a pleasing appearance and permit air to flow freely through frieze board 24 and into the entry end of duct 21. To prevent the entry of insects into duct 21 and thence into attic 10, a screen 26 is provided behind louvers 25.

In keeping with standard construction practices, vented frieze board 24 will be installed, along with duct 21, prior to installation of sheathing 14 atop rafters 13. Thus, one or more nails N will be driven into the lower edge of frieze board 24 and into the lintel atop the wall of the building under construction. Other nails will be affixed to attachment tabs 23 to hold duct 21 in position. When the sheathing is placed on rafters 13 above frieze board 24 a nail may be driven through the sheathing 14 and into the edged dimension of frieze board 24, as shown at the top of board 24 in FIG. 5. Most building codes require that frieze boards have a sufficient thickness to accept a nail driven down through the sheathing into the edged dimension of the frieze board. For this reason, invention 20 is provided with a frieze board 24 of sufficient thickness to accept such nail.

With a ventilated frieze board 24 backed up by a duct 21 housed beneath roof sheathing 14 and rafters 13, a free flow of air into attic space 10 would, generally, be assured. However, to this point, the intent of invention 20 could be defeated if, upon application by air blowing techniques, insulation is applied to the attic space 10. Such insulation would readily enter into the air flow exit end of duct 21, the right most end of the duct as illustrated in FIG. 5. To preclude the possibility of insulation being blown into duct 21 and impeding free air flow through that duct, a removable insulation shield 29 is provided. For exemplary purposes, and not to imply any limitations, insulation shield 29 is illustrated as a cardboard insert which acts as a closure to close the exit end of duct 21. Invention 20 is installed between rafters 13 and beneath sheathing 14 with removable insulation shield 29 in place. After the attic space 10 is closed, insulation 15 is blown into the attic space 10. None of the insulation can enter duct 21 because of the closure provided by insulation shield 29. After the insulation has been emplaced, a rod 30 is inserted through frieze board 24 and the entry of duct 21 so as to extend through duct 21 and come into contact with insulation shield 29. A thrust on rod 30 pushes shield 29 so as to move it outward and away from duct 21. This permits the exit of duct 21 to become uncovered and air will then flow freely through the vented frieze board 21, into duct 21, and thence into the attic space 10.

What has been disclosed is a ducted frieze vent which creates a duct-way for the free flow of air beneath the roof sheathing and between a pair of roof rafters and into the space beneath the building's roof. The frieze board employed has a sufficient thickness to accept a nail driven down through the roof sheathing as is required by many building codes. The duct-way is provided with a removable closure which is first positioned to prevent entry of airborne insulation into the duct-way. After insulation has been emplaced, the duct-way closure is removed by manual actuation of a rod by a person exterior of the building and of the insulated space.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. In a building having roof sheathing supported by rafters, and a space beneath said sheathing to be ventilated by air flowing beneath said sheathing and between selected pairs of said rafters, and insulation applied to said space, the application of said insulation tending to block the free flow of air into said space, the improvement comprising:

an air ventilation duct coupled between one of said selected pairs of said rafters for the free flow passage of air therethrough to said space to be ventilated, said duct having an input end and an output end for the entry and exit of air;

closure means closing said output end of said duct for precluding the entry into said duct of said insulation when said insulation is applied to said space; and, means coupled to said closure means for actuating said closure means to open said output end of said duct after said insulation has been applied.

2. The improvement of claim 1 wherein said means for opening said output end of said duct is coupled through said input end of said duct to said closure means and comprises means for moving said closure means.

3. The improvement of claim 1 further comprising a vented frieze board coupled between said one of said selected pairs of said rafters and adjacent said input end of said duct.

4. The improvement of claim 3 wherein said means for opening said output end of said duct is coupled through said input end of said duct to said closure means and comprises means for moving said closure means.

5. The improvement of claim 3 wherein said vented frieze board has a thickness sufficient to accept a nail driven through said sheathing and into said frieze board.

6. The improvement of claim 3 further comprising coupling means for coupling said vented frieze board between said one of said selected pairs of said rafters, said coupling means comprising means pivotally coupling said vented frieze board at said input end of said duct.

7. In a building having roof sheathing supported by rafters, and a space beneath said sheathing to be ventilated by air flowing beneath said sheathing and between selected pairs of said rafters, and insulation applied to said space, the application of said insulation tending to block the free flow of air into said space, the improvement comprising:

an air ventilation duct coupled between one of said selected pairs of said rafters for the free flow passage of air therethrough to said space to be ventilated, said duct having an input end and an output end for the entry and exit of air;

a vented frieze board pivotally coupled to said duct adjacent said input end of said duct; and means coupled to said closure means for opening said output end of said duct after insulation has been applied, said means for opening said output end of said duct being coupled through said input end of said duct to said closure means and comprising means for moving said closure means;

8. The improvement of claim 7 wherein said vented frieze board has a thickness sufficient to accept a nail driven through said sheathing and into said frieze board.

9. The improvement of claim 7 further comprising closure means closing said output end of said duct for precluding the entry into said duct of said insulation when said insulation is applied to said space.

10. In a building having roof sheathing supported by rafters, and a space beneath said sheathing to be ventilated by air flowing beneath said sheathing and between selected pairs of said rafters, and insulation applied to said space, the application of said insulation tending to block the free flow of air into said space, the improvement comprising:

in combination with said sheathing and said rafters, means forming an air flow duct-way beneath said sheathing and between one of said selected pairs of rafters, said duct-way having input and output ends;

closure means for temporarily closing said output end of said duct-way to inhibit accessible entry to said duct-way through said output end; and, means coupled to said closure means, through said input end of said duct-way, for moving said closure means to open said output end of said duct-way.

11. The improvement of claim 10 further comprising a vented frieze board coupled to said duct-way adjacent said input end.

12. The improvement of claim 11 further comprising pivotal coupling means pivotally coupling said frieze board to said duct-way.

13. The improvement of claim 12 wherein said vented frieze board has a thickness sufficient to accept a nail driven through said sheathing and into said frieze board.

* * * * *